US006331666B1

(12) United States Patent
Chang

(10) Patent No.: US 6,331,666 B1
(45) Date of Patent: Dec. 18, 2001

(54) MOVEABLE HOLDER STRUCTURE FOR THE FOOT PEDAL OF A DRUM

(75) Inventor: Jung-Pin Chang, Taipei (TW)

(73) Assignee: New Sound Enterprise & Musical Instrument Mfg. Co. Ltd., Tai-Chung Hsien (TW)

( * ) Notice: Subject to any disclaimer, the term of this patent is extended or adjusted under 35 U.S.C. 154(b) by 0 days.

(21) Appl. No.: 09/664,366

(22) Filed: Sep. 18, 2000

(51) Int. Cl.[7] ..... G10D 13/02

(52) U.S. Cl. ..... 84/422.1; 84/422.2; 84/411 R; 84/422.3

(58) Field of Search ..... 84/422.1, 422.2, 84/422.3, 411 R

(56) References Cited

U.S. PATENT DOCUMENTS 5,185,489 * 2/1993 Hoshino ..... 84/422.1
5,641,924 * 6/1997 Hsieh ..... 84/422.1
6,011,208 * 1/2000 Hoshino ..... 84/422.1

* cited by examiner

*Primary Examiner*—Shih-Yung Hsieh
(74) *Attorney, Agent, or Firm*—A & J

(57) ABSTRACT

A moveable holder structure for the foot pedal of a drum having a base seat pivotally mounted with an urging element, one end of the foot pedal corresponding to the urging element being a locking bolt which urges the base seat such that the other end of the urging element is fastened to the drum edge, characterized in that the urging element, corresponding to one end of the drum edge, is pivotally mounted with a moveable block, and the end portion of the urging element is provided with two corresponding protruded lugs having a long slot, the two sides at the top of the moveable block form into a circular protruded block which is adapted to the long slot, thereby a moveable holder structure for foot pedal of a drum which can be easily combined is obtained.

2 Claims, 5 Drawing Sheets

MOVEABLE HOLDER STRUCTURE FOR THE FOOT PEDAL OF A DRUM

BACKGROUND OF THE INVENTION (a) Technical Field of the Invention

The present invention relates to a moveable holder structure for the foot pedal of a drum, and in particular, to a holder structure having protruded lugs on an urging element formed with a long slot and having a moveable pressing block forming a circular protruded block corresponding to the protruded lugs. The structure allows a rapid combination with the edge of a drum and also reduces the cost of manufacturing.

(b) Description of the Prior Art

FIGS. 1, 2A and 2B show a conventional foot pedal 10 of a drum, and the pedal beats onto the surface of the drum (not shown) by means of a chain. The foot pedal 10 is mounted to the drum edge 40 of the big drum by means of a holding structure. The base seat 11 of the foot pedal 10 is pivotally mounted with a moveable urging element 12 which can move forward and backward. The urging element 12, corresponding to one end of the inner side of the foot pedal 10, is mounted with a locking blot 13, and the other end of the urging element 12 is provided with two corresponding protruded lugs 14 respectively having a pivotal hole 140. There is a pressing block 15 pivotally mounted in between the two protruded lugs 14, and the top of the pressing block 15 is extended with a protruded block 16 having a pivotal hole 160. A rivet 17 mounts in sequence into the protruded lugs 14 and the pivot holes 140, 160 of the pressing lugs 14 and the protruded block 16, and is then rivetted, such that the pressing block 15 is pivotally mounted to the urging element 12. When the user rotates the locking bolt 13 to urge against the base seat 11, the pressing block 15 and the base seat 11 of the other end of the urging element 12 are correspondingly fastened to the drum edge 40.

This conventional holding structure has the following drawbacks:

1) In combination of the pressing block 15, the pivotal hole 160 of the protruded block 16 has to be in alignment with the pivotal hole 140 of the protruded lug 14. Next, the rivet 17 passes through the protruded lugs 14 and the pressing block 15 and the end of the rivot 17 is opened to allow the pressing block 15 to pivotally mounted onto the urging element 12. The entire process of combination is complicated. Besides, after rivetting, it is not easy to be dismantled.
2) It requires more materials, time and tools in order to combine the pressing block 15. Thus, the cost of combination is high and the time taken is comparatively longer.
3) The pivotal holes 160, 140 of the protruded block 16 and the protruded lugs 14 are mounted by means of rivet. The size of the pivotal holes 160, 140 and the external diameter of the rivet 17 are of similar size without tolerance. If the pressing block 15 and the drum edge 40 are not in the located at the same level position, the pressing block 15 will press against the drum edge 40 at a single point. Thus, the holding force is affected and the drum edge 40 may be damaged. This will affect the sound output of the drum.

SUMMARY OF THE INVENTION

Accordingly, it is an object of the present invention to provide a moveable holder structure for the foot pedal of a drum, which improves the speed of combination of the structure onto a drum set to eliminate unnecessary steps.

Yet another object of the present invention to provide a moveable holder structure for the foot pedal of a drum, wherein the cost of manufacturing is lowered, and the products is more competitive.

A further object of the present invention to provide a moveable holder structure for the foot pedal of a drum, wherein the strength of the holding force is increased and the drum edge is protected.

One aspect of the present invention is to provide a moveable holder structure for the foot pedal of a drum having a base seat pivotally mounted with an urging element, one end of the foot pedal corresponding to the urging element being a locking bolt which urges the base seat such that the other end of the urging element is fastened to the drum edge, characterized in that the urging element, corresponding to one end of the drum edge, is pivotally mounted with a moveable block, and the end portion of the urging element is provided with two corresponding protruded lugs having a long slot, the two sides at the top of the moveable block form into a circular protruded block which is adapted to the long slot thereby a moveable holder structure for foot pedal of a drum which can be easily combined is obtained.

Other object and advantages of the present invention will become more apparent from the following description taken in conjunction with the accompanying drawing.

DETAILED DESCRIPTION OF THE PREFERRED EMBODIMENT

Figure 1:
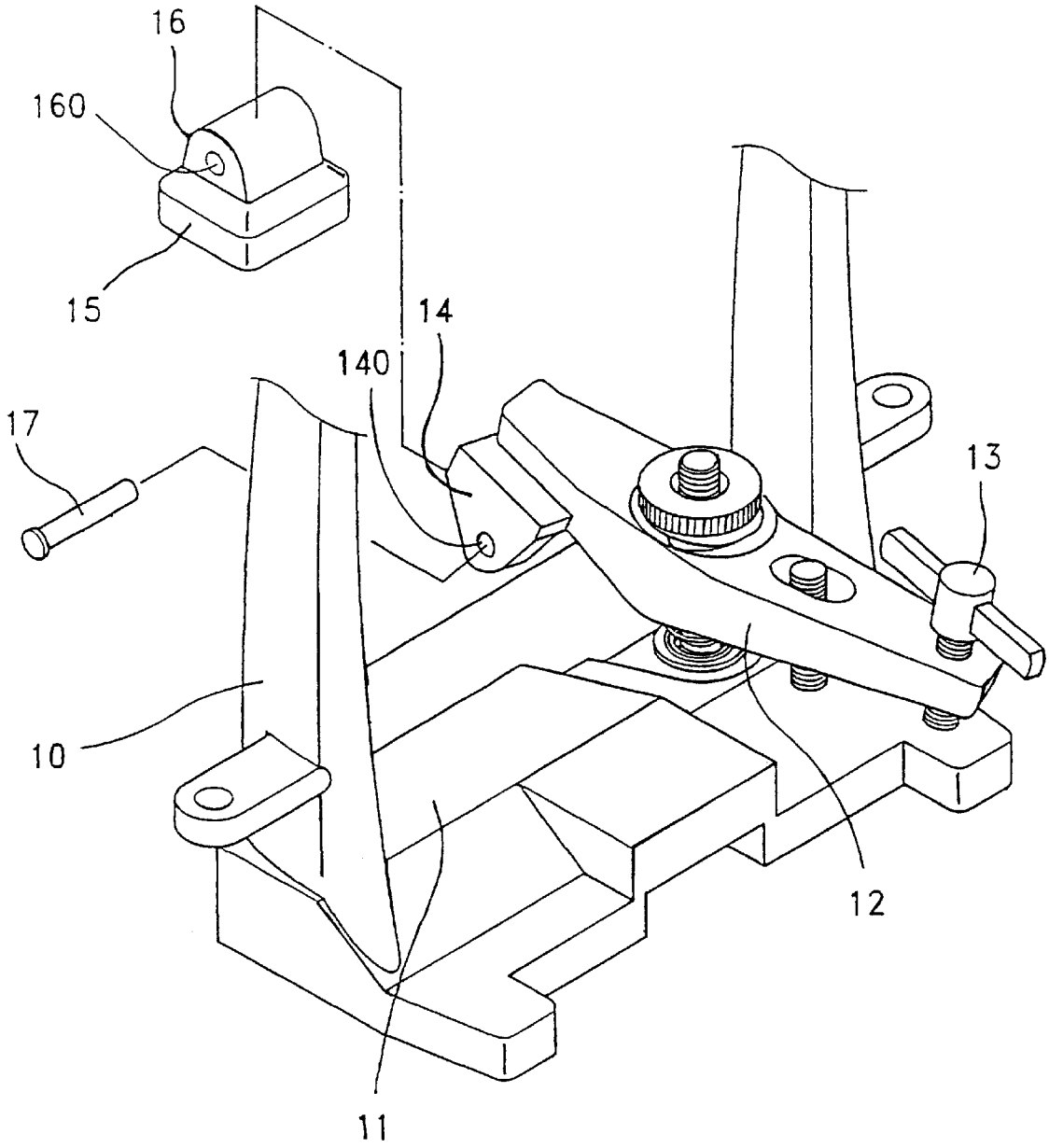
PRIOR ART FIG. 1
FIG. 1 is a perspective view of a conventional foot pedal for a drum, showing the structure of the holder of the foot pedal.
Figure 2A:
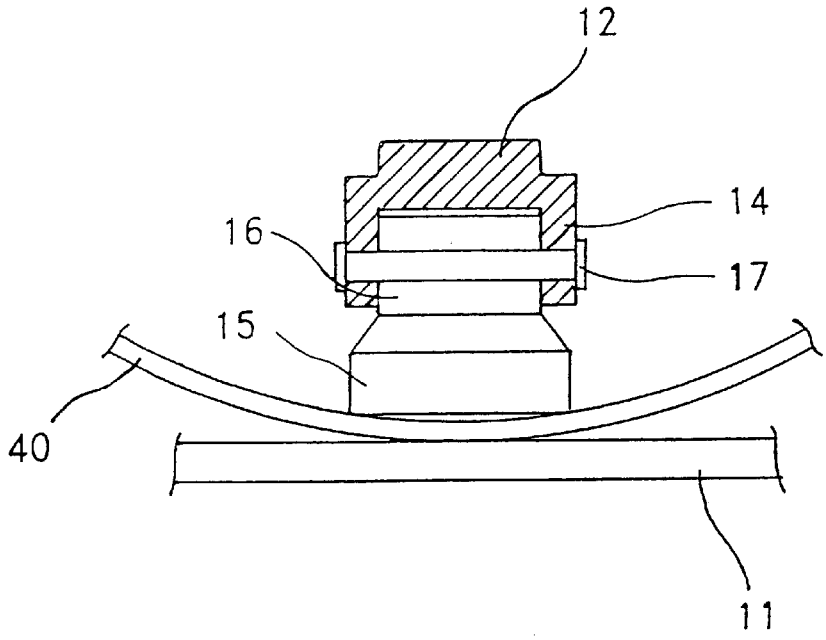
PRIOR ART FIG. 2A
FIGS. 2A and 2B are schematic sectional views of a conventional foot pedal mounted at a big drum, showing the relationship of the holder structure and the drum edge of the drum.
Figure 2B:
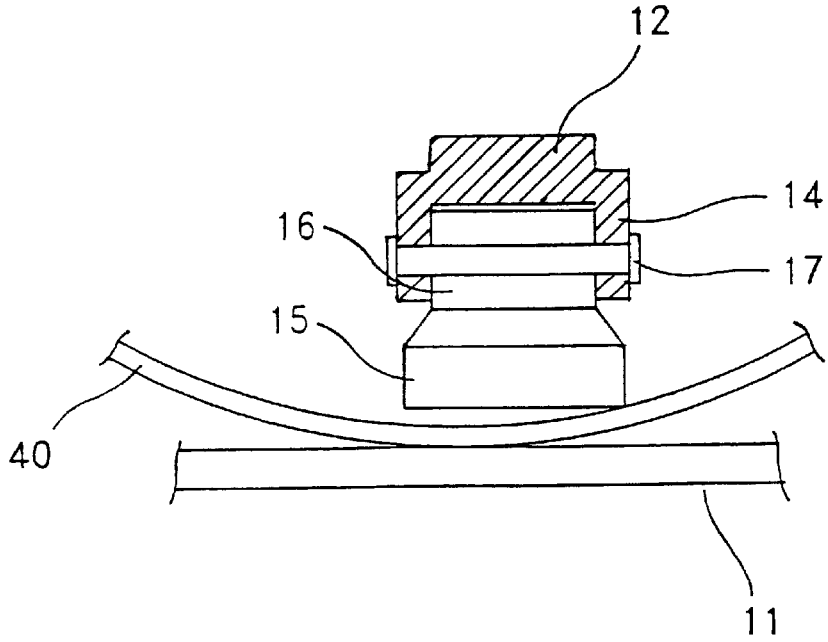
PRIOR ART FIG. 2B
Figure 3:
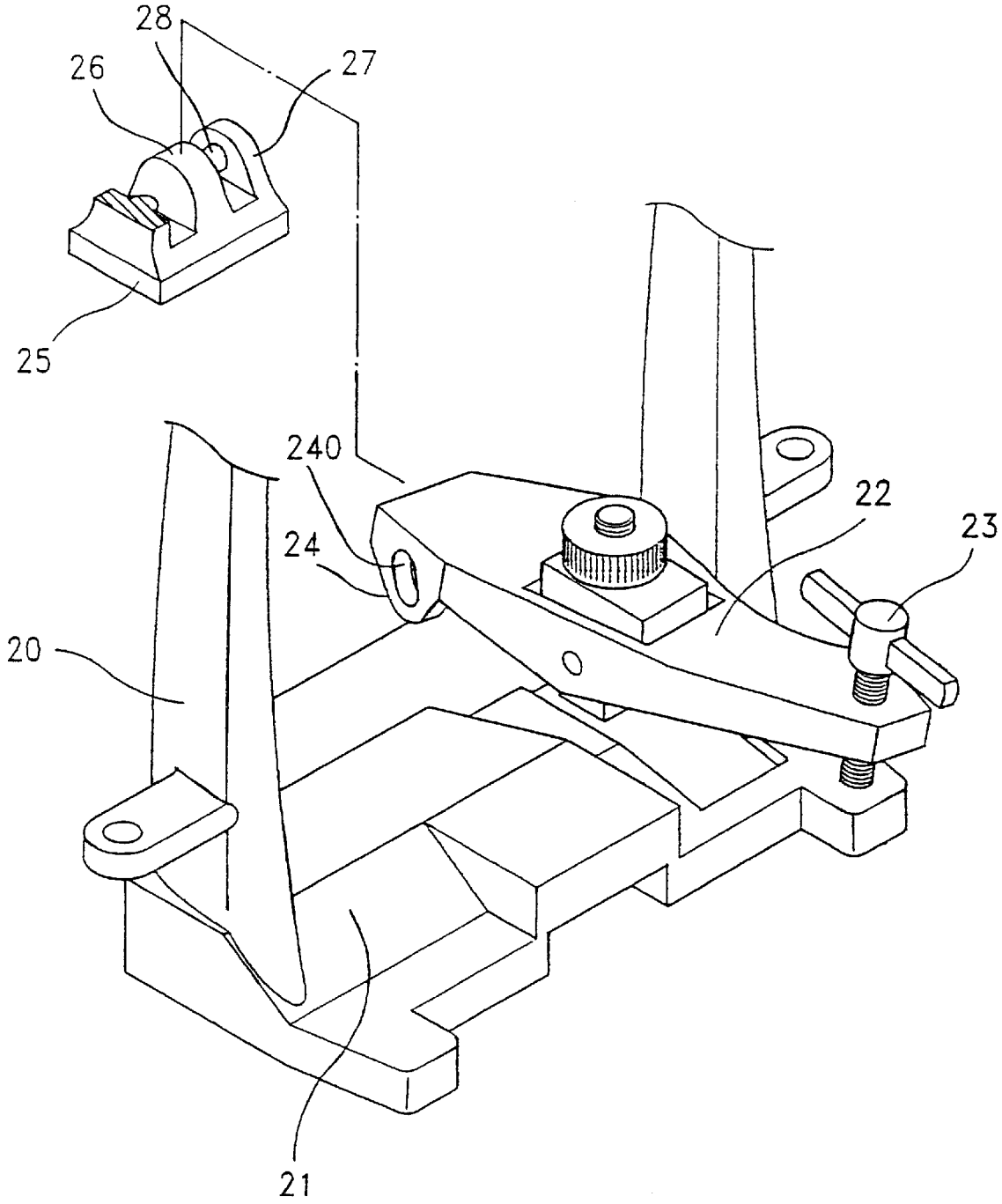
FIG. 3 is a perspective view of the foot pedal of the present invention, showing the formation of the holder structure in accordance with the present invention.
Figure 4A:
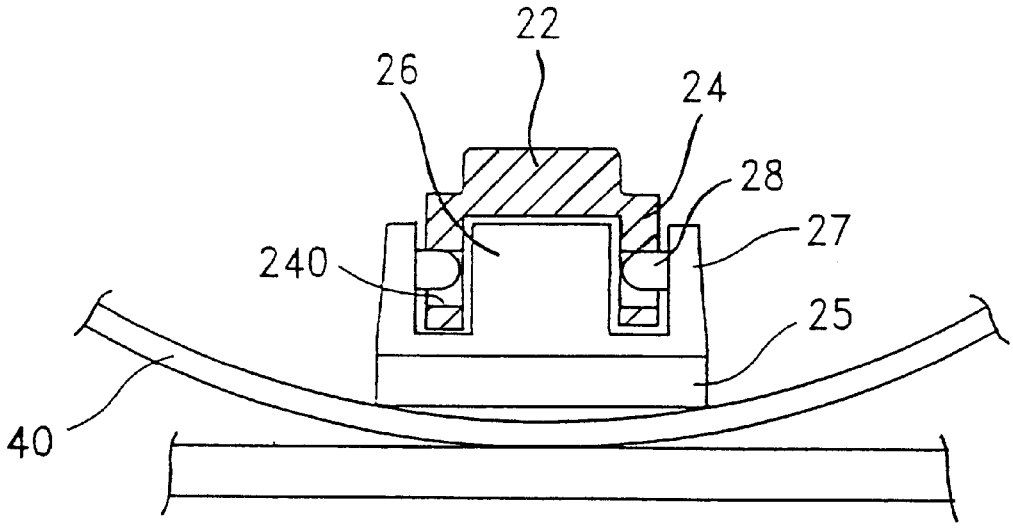
FIGS. 4A and 4B are schematic views showing the relationship of the foot pedal with the big drum in accordance with the present invention.
Figure 4B:
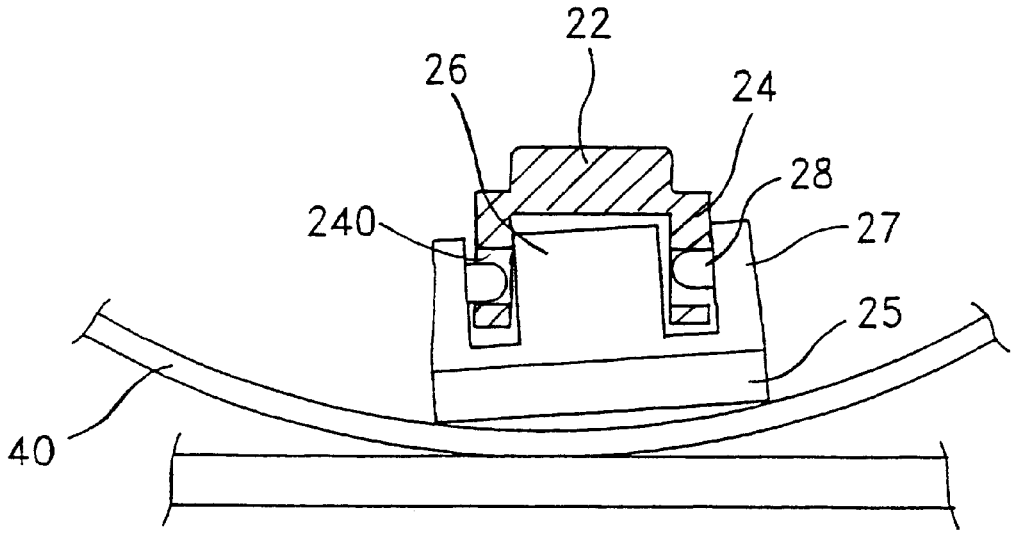

Referring to FIGS. 3, 4A and 4B, there is shown a moveable holder structure for the foot pedal of a drum, wherein the holder structure of the foot pedal 20 has an urging element 22 which can move forward and backward and is mounted at a base seat 21 of the foot pedal 20. The urging element 22, corresponding to one end of the inner side of the foot pedal 20, and is provided with a locking bolt 23 which presses against the base seat 21. The other end of the urging element 22 is pivotally mounted with a moveable block 25. When the user rotates the locking bolt 23 to urge against the base seat 21, the moveable block 25 of the urging element 22 faces downward, and together with the base seat 21, these components correspond to the drum edge 40.

Referring again to FIGS. 3, 4A and 4B, the urging element 22, corresponding to one end of the moveable block 25, is downwardly extended to form a pair of protruded lugs 24.

There is a long slot 240 formed on the protruded lugs 24. The top surface of the moveable block 25 is provided with a positioning plate 26 which can be mounted in between the two protruded lugs 24. The two lateral sides at the top surface of the moveable block 25 are respectively provided with a side plate 27. The two side plates 27 are provided respectively with a circular protruded block 28 along the long slot 240 of the protruded lugs 24, such that the moveable block 25 together with the circular protruded block 28 pivotally mounted to the protruded lugs 24 of the pressing element forms into the holder structure of the present invention.

FIGS. 3, 4A and 4B show the operation of the present invention. When forming the moveable block 25, the circular protruded block 28 on the side plate 27 is located to correspond to the protruded lugs 24 of the pressing element 22. Next, the circular protruded block 28 is pushed towards the long slot 240 of the protruded lugs 24. The elasticity of the side plates 27 and the arch-shaped surface of the protruded block 28 facilitate the protruded block 28 to slided into the long slot 240. Thus, the moveable block 25 is combined. To dismantle the structure, the components are pulled apart. Thus, no other additional tools are required to proceed with the combination of the structure.

As the circular protruded block 28 is smaller than the long slot 240 of the protruded lug 24, when the foot pedal 20 is to be locked at the drum edge 40. The circular protruded block 28 can slide along the long slot 240 up and down. Thus, the block 25 is moveable. If the drum edge 40 is not at a level position, the moveable block 25 can automatically compensate the tilting angle to main a strong holding so as to avoid dislocation.

Figure 5:
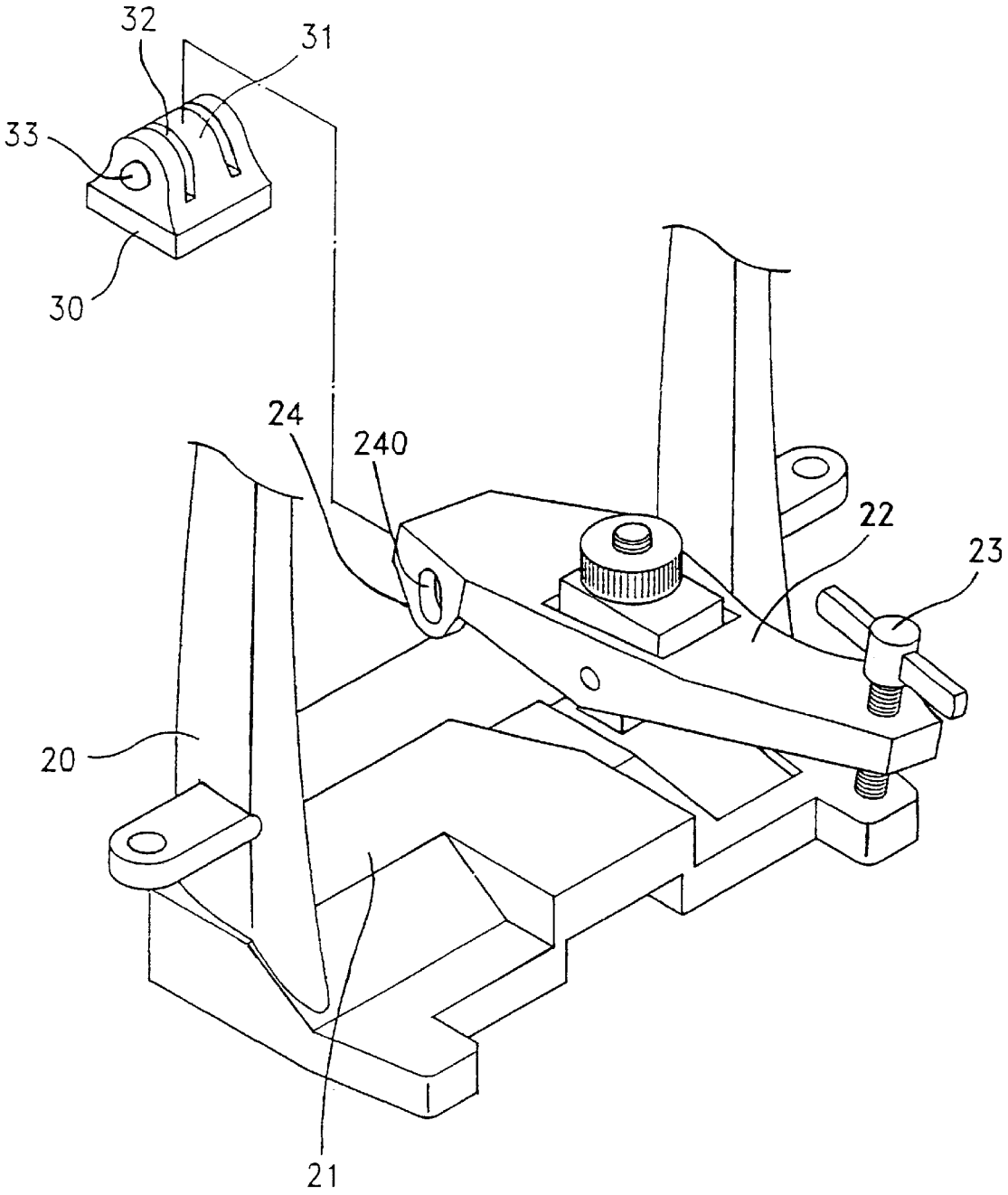
FIG. 5 is another preferred embodiment of the present invention, showing another structure of the holder in accordance with the present invention.

In another preferred embodiment of the present invention, and as shown in FIG. 5, the front end of the urging element 22 is pivotally mounted with a moveable block 30. The moveable block 30 has a protruded block 31 at the top face thereof, and the two sides of the protruded block 31 are respectively provided with a notch 32 such that the two side walls of the protruded block 31 are with flexibility. Additionally, the two lateral walls of the protruded block 31 are respectively formed externally into a circular protruded block 33. The two circular protruded blocks 33 are corresponding to the long slot 240 of the protruded lugs 240. Thus the moveable block 30 is pivotally mounted to the urging element 22 and the protruded block 33 by means of the circular protruded block 33. Due to the flexibility of the two lateral side walls of the protruded blocks and the arch-shaped surface of the circular protruded block 33, the combination of the structure is attained.

In accordance with the present invention, there are advantages as follows

1) Quick Combination:

As the moveable block 25 makes use of the flexibility of the side plates 27 and the arch-shaped surface of the circular protruded block 28 to be pivotally mounted to the urging element 22, this avoid the need of the rivetting process. Thus, the combination of the present structure is quick, and the effectiveness of the structure is improved.

2) Low Cost:

Due to the easy combination of the moveable block, unnecessary material and devices are not required, and no additional labour force is required. Thus, the entire cost of production is low.

3) Strong Holding Capability:

By using the circular protruded block 28 to move along the long slot 240 of the protruded lugs 24, the moveable block 25 can be used on drum edge 40 with different tilting angle.

While the invention has been described with respect to preferred embodiment, it will be clear to those skilled in the art that modifications and improvements may be made to the invention without departing from the spirit and scope of the invention. Therefore, the invention is not to be limited by the specific illustrative embodiment, but only by the scope of the appended claims.

I claim:

1. A movable holder structure for a foot pedal of a drum comprising:

a base seat; an urging element pivotally mounted on said base seat; one end of said urging element having a locking bolt pressing against said base seat; an other end of said urging element having a pair of protruding lugs, each of said lugs having a long slot; a movable block having a positioning plate and two flexible side plates protruding from a top surface of said movable block; said positioning plate formed to fit between said pair of protruding lugs; each inner side of said two flexible side plates having a circular protruded block; said circular protruded block formed to engage said long slot on said lugs correspondingly, and therefore pivotally mounted said movable block on said other end of said urging element; said movable block fastened to a drum edge by rotating said locking bolt.

2. A movable holder structure for a foot pedal of a drum comprising:

a base seat; an urging element pivotally mounted on said base seat; one end of said urging element having a locking bolt pressing against said base seat; an other end of said urging element having a pair of protruding lugs, each of said lugs having a long slot; a movable block having a protruding top surface with notches forming two flexible side walls; said top surface formed to fit between said pair of protruding lugs; each outer side of said two flexible side walls having a circular protruded block; said circular protruded block formed to engage said long slot on said lugs correspondingly, and therefore pivotally mounted said movable block on said other end of said urging element; said movable block fastened to a drum edge by rotating said locking bolt.

* * * * *